US008815366B2

(12) United States Patent
Günther

(10) Patent No.: US 8,815,366 B2
(45) Date of Patent: Aug. 26, 2014

(54) REINFORCED CONCRETE COMPONENT REINFORCED WITH L-SHAPED SHEET METAL PIECES

(75) Inventor: Gerd Günther, Bad Orb (DE)

(73) Assignee: Technische Hochschule Mittelhessen, Gießen (DE)

( * ) Notice: Subject to any disclaimer, the term of this patent is extended or adjusted under 35 U.S.C. 154(b) by 267 days.

(21) Appl. No.: 13/387,590

(22) PCT Filed: Jul. 19, 2010

(86) PCT No.: PCT/EP2010/060389

§ 371 (c)(1), (2), (4) Date: Mar. 21, 2012

(87) PCT Pub. No.: WO2011/012483

PCT Pub. Date: Feb. 3, 2011

(65) Prior Publication Data

US 2012/0177873 A1 Jul. 12, 2012

(30) Foreign Application Priority Data

Jul. 31, 2009 (DE) ..... 10 2009 035 800
Dec. 5, 2009 (DE) ..... 10 2009 056 826

(51) Int. Cl.
*E04C 5/18* (2006.01)
*E04C 5/16* (2006.01)
*E04C 5/06* (2006.01)

(52) U.S. Cl.
CPC ..... *E04C 5/0645* (2013.01); *E04C 5/163* (2013.01); *E04C 5/166* (2013.01); *E04C 5/168* (2013.01)
USPC ..... 428/99; 428/105; 428/223; 52/677

(58) Field of Classification Search
CPC ..... E04C 5/168; E04C 5/166; E04C 5/18
USPC ..... 428/99, 105, 223; 52/677, 684, 687, 52/689
See application file for complete search history.

(56) References Cited

U.S. PATENT DOCUMENTS 1,613,351 A * 1/1927 Klinger et al. ..... 404/135
2,911,819 A 11/1959 Austin
2008/0209843 A1 9/2008 Helms

FOREIGN PATENT DOCUMENTS

CH 412 275 A 4/1966
DE 2727159 A1 12/1978

(Continued)

OTHER PUBLICATIONS

International Search Report and Written Opinion for PCT/EP2010/060389, mailed Sep. 15, 2010.

(Continued)

*Primary Examiner* — Alexander Thomas
(74) *Attorney, Agent, or Firm* — Marshall, Gerstein & Borun LLP

(57) ABSTRACT

Reinforced concrete component with at least one upper and at least one lower longitudinal reinforcement layer, and one transverse force reinforcement. Transverse force reinforcement being passed to the upper and lower longitudinal reinforcement in its extension. The transverse force reinforcement is formed by at least 20 L-shaped sheet metal components made from structural steel with stirrups attached thereto. Each sheet metal component thereby comprises a chamfer.

27 Claims, 7 Drawing Sheets

(56) References Cited

FOREIGN PATENT DOCUMENTS

| | | | |
|---|---|---|---|
| DE | 29812676 | U1 | 12/1998 |
| DE | 20309548 | U1 | 9/2003 |
| EP | 928859 | A1 | 7/1999 |
| EP | 1 055 784 | A1 | 11/2000 |
| EP | 1180565 | A1 | 2/2002 |
| FR | 2303133 | A1 | 10/1976 |
| WO | WO-2004/081313 | A1 | 9/2004 |
| WO | WO-2005/035900 | A1 | 4/2005 |
| WO | WO-2006/061461 | A1 | 6/2006 |
| WO | WO-2006/061462 | A1 | 6/2006 |

OTHER PUBLICATIONS

International Search Report and Written Opinion for PCT/US2010/060384, mailed Sep. 9, 2010.

* cited by examiner

REINFORCED CONCRETE COMPONENT REINFORCED WITH L-SHAPED SHEET METAL PIECES

CROSS-REFERENCE TO RELATED APPLICATIONS

This is the U.S. National Stage of International Patent Application No. PCT/EP2010/060389, having an international filing date of Jul. 19, 2010, and which claims priority benefit of German application number 10 2009 035 800.5, filed Jul. 31, 2009 and German application number 10 2009 056 826.3, filed Dec. 5, 2009, the contents of each of the foregoing applications hereby being incorporated herein in the entirety.

FIELD OF THE DISCLOSURE

The present disclosure relates to a concrete component with at least one upper and at least one lower longitudinal reinforcement layer, and a transverse force reinforcement, wherein its extension is passed above the uppermost and lowermost longitudinal reinforcement, wherein the transverse force requirement is formed by at least 20 L-shaped sheet metal components made from structural steel with stirrups attached thereto.

BACKGROUND

In reinforced concrete or prestressed concrete components, shear reinforcement is often required in the area of column connections, in particular in the area of prop connectors, in order to absorb the transverse forces occurring due to column forces.

Such shear reinforcement elements are widely known in the form of S-Hooks or stirrups, dowel bars, double-headed bolts, stirrup meshes, open web girders, Tobler Walm®, "Geilinger" collars and "Riss" stars.

Due to bad anchorage, shear reinforcement in the form of S-hooks or stirrups has to grasp a usually available flexural longitudinal reinforcement in order to prevent the shear reinforcement from being ripped out. The installation procedure is highly time-consuming and therefore also cost-intensive. Conventional stirrups are no longer considered suitable to be fitted at high degrees of reinforcement in the bending tensile reinforcement and at a high proportion of reinforcement.

In the dowel bar known from DE 27 27 159 A1, the dowels are provided with an enlarged dowel head at their end. The dowels are welded at their other end to a dowel support rail. A further development of such a dowel bar is known, for example, from DE 298 12 676 U1. This dowel bar comprises several dowels arranged at a specific distance from one another; these dowels comprise an extended plate-shaped dowel head at one end of the dowel shaft and are attached to a joint dowel support rail at the other end, wherein the respective dowel shaft extends through a dowel drill hole in the dowel support rail, and is provided with a rivet head.

Though such dowel bars are used in diverse ways, practical experience has shown that these dowel bars fail when subjected to strong shear forces because the dowels then become bent. As a result, the connection between concrete and reinforcement becomes loose, and the durability of the concrete component cannot always be provided.

Double-headed bolts comprise a cylindrical bolt and an above or below-lying bolt head which is enlarged in comparison to the bolt and which is generally arranged in the approximate form of a truncated cone. Several such bolts are connected via a distance rail attached at the upper or lower bolt head to a shear reinforcement element, wherein the distance rail ensures correct orientation as well as the correct height position of the double-headed bolts in their state of assembly.

One disadvantage of this shear reinforcement element is that the production of these double-headed bolts is relatively time-consuming and is carried out, by way of example, by clinching the bolt ends to produce the bolt heads or by welding the bolt heads in the form of truncated cones to the bolt.

In addition, the double-headed bolts are usually threaded from above in a star-shaped manner between the upper and lower layer of the longitudinal reinforcement. With high degrees of reinforcement in the bending tensile reinforcement and different mesh openings in the upper and lower reinforcement layer, installation is therefore highly difficult, and is sometimes even impossible.

Tobler Walm® and "Geilinger" Collars are steel mounting components which consist of welded steel profiles and which are individually produced. Movement of the mounting components requires the use of lifting gear due to their high net weight. Production and installation are time-consuming and cost-intensive, as this lifting equipment is not available for other tasks on the construction site or has to be reserved specifically for this task. Due to their size and weight, these solutions cannot be used in prefabricated components, as transportation to the construction site would no longer be cost-efficient. These concrete reinforcement elements are therefore only suitable to be used for concrete components which are produced using on-site mixed concrete.

GENERAL DESCRIPTION

The aim of the present disclosure—is to overcome these and other disadvantages of the state of the art by providing a concrete component which is also suitable for absorbing large shear forces or transverse forces. The reinforced concrete or prestressed concrete component also has to be suitable to be produced at a reasonable price and to be simple to install. Ideally, it also has to be producible as a prefabricated component.

For a reinforced concrete component with at least one upper and at least one lower longitudinal reinforcement layer, and one transverse force reinforcement, wherein the latter is passed above the uppermost and lowermost longitudinal reinforcement in its extension, the disclosure—provides that the transverse force reinforcement is formed by at least 20 L-shaped sheet metal components made from structural steel and stirrups attached thereto. The advantageous arrangement according to the present disclosure—of the transverse force reinforcement comprising at least 20 L-shaped sheet metal components and stirrups attached thereto ensures that there is good composite action between the concrete and the reinforcement due to the large number of elements. Such a concrete component is suitable to be produced at a reasonable price and has a high load-bearing capacity. Furthermore, the composite action is increased by the L-shape of the sheet metal component and a stirrup attached thereto, as the sheet metal component is wedged into the concrete in combination with the stirrups in a complex manner.

The production costs of the concrete component are extremely low due to the arrangement of the transverse force reinforcement according to the present disclosure—, as standard commercial structural steel is suitable to be used. Due to the simple geometry of the L-shaped sheet metal components, they are suitable to be manufactured in series production as free-falling punched parts. As a result, no welding procedures, screw connections or soldered joints are required. The production costs of a concrete component according to the present disclosure—are significantly reduced due to this arrangement, especially as the stirrups are also produced using cost-effective structural steel. The transverse force reinforcement of a concrete component according to the present disclosure—is quickly installed at the construction site, and is cost-effective with regard to production and installation, as no special knowledge or skills are required.

Aside from the shear resistance of the reinforced concrete component, the punching shear strength is also significantly increased in comparison to conventional constructions, as transverse forces and bending moments are absorbed more effectively and distributed more favorably within the reinforced concrete component. Cracks caused by transverse force therefore remain small, and the bearing load of the reinforced concrete component is suitable to be significantly increased in comparison to conventional solutions.

A further significant advantage is that the shear force transmission in the shear joint, which can be detected in element slabs, is also suitable to be absorbed by the sheet metals.

Furthermore, the arrangement according to the present disclosure—offers the advantage of only one sheet metal size having to be kept available. Identical sheet metal components can even be used in the case of varying ceiling thicknesses, which would usually require the adjustment of the transverse force reinforcement to the cross section of the ceiling. It is only necessary to adjust the length of the stirrups. As a result of this, stock costs are suitable to be minimized; construction costs are significantly reduced.

In the production of element slabs in the prefabrication plant, the same sheet metal components can therefore always be used. For this purpose, a sheet metal length is chosen which continues to protrude from the prefabricated ceiling. The transverse force reinforcement is completed upon mounting the stirrups at the construction site. As a result, the component height of an element slab is reduced. More element slabs are thus suitable to be transported simultaneously, thereby reducing transport and other logistics costs.

The transverse force reinforcement is preferably formed from at least 50 sheet metal components, and particularly preferred from at least 70 sheet metal components. The stress in the concrete component can be distributed highly homogeneously through a large number of sheet metal components. This further increases the load-bearing capacity, and ensures a higher ductility within the component.

In order to further improve the composite action of the transverse force reinforcement in the reinforced concrete component according to the present disclosure—, each sheet metal component has a chamfer at one end. The chamfer is hereby passed to the lowest longitudinal reinforcement. The arrangement according to the present ensures a better strain distribution within the zones of the reinforced concrete component subjected to transverse force, as the connection between the sheet metal component and the surrounding concrete is improved. The stirrup attached to the sheet metal component hereby protrudes over the uppermost longitudinal reinforcement, so that the transverse force reinforcement formed by the L-shaped free-falling sheet metal component and the stirrup attached thereto extends over the uppermost and lowermost longitudinal reinforcement. The transverse force flow is therefore suitable to be distributed over approximately the entire reinforced concrete component slab.

The chamfer of the sheet metal component is preferably located at the opposite side of the stirrup, and is thereby passed to the lowest longitudinal reinforcement. This arrangement according to the present disclosure—ensures a better strain distribution. The sheet metal component, of which the cross-section is L-shaped, thereby grasps the lowest bars of the longitudinal reinforcement layer with the chamfer, so that the punching shear reinforcement is successfully anchored without being prone to slippage by means of the sheet metal component in the pressure zone. Within the concrete tensile stress zone, this is achieved by means of the stirrup.

Two circular recesses are particularly preferably arranged within the chamfer. Concrete is suitable to penetrate these circular recesses and therefore ensure a dovetailing of the sheet metal component with the concrete. The reinforced concrete component therefore obtains an extremely high load-bearing capacity. Furthermore, the sheet metal components are therefore firmly anchored and do not slip when the concrete is poured in.

A longitudinal reinforcement bar passed through each recess of the lower longitudinal reinforcement improves the load-bearing capacity of the reinforced concrete component according to the present disclosure—, as forces introduced diagonally are divided into a normal force component and a transverse force component due to the composite action. As a result, the reinforced concrete component possesses further increased ductility.

The arrangement of the disclosure—is then particularly advantageous when the chamfers are arranged with additional cut-outs. As a result, the composite action between the sheet metal components and the concrete in the reinforced concrete component is again further improved, and the load-bearing capacity of the reinforced concrete component is again increased.

Advantageously, each sheet metal component comprises a thickness of 3 or 5 mm. Experiments carried out for the sake of the load-bearing capacity have shown that the optimum ratio of shear resistance with regard to the composite action is not achieved using alternatively selected thicknesses. Furthermore, the provision of only two sheet metal components is particularly beneficial with regard to material costs. The sheet metal components do not require a specific adjustment. In fact, they are suitable to be produced on demand. Therefore, storage and provision costs for different sheet metal components are avoided.

According to the present disclosure—, the sheet metal components including the stirrups connected thereto are arranged in a preferred embodiment with uniform distribution around an area with high transverse force. As a result, the calculation of the reinforced concrete component is suitable to be carried out using simple means and existing possibilities. Extensive calculations for each individual case are therefore suitable to be avoided. Furthermore, it is advantageous according to the present disclosure—if the sheet metal components are arranged parallel to each other. As a result, simple geometries which serve to calculate the reinforced concrete component are suitable to be achieved. The construction of the reinforced concrete component according to the present disclosure—is therefore easy to produce and is cost-effective.

The arrangement of the sheet metal components serving as reinforcement is concentrated into a core area during mounting in a reinforced concrete component. The large amount of reinforcement arranged there and the way in which this is achieved using sheet metal components significantly increases the punching shear strength of the concrete component. At a greater distance from the core area, which ideally lies in the area of the strongest transverse force, e.g. in the area of a column, the amount of sheet metal components is advantageously suitable to be reduced. The tangential distances of the reinforcement components are suitable to be lengthened with increasing distance from the core area.

Advantageously, the disclosure—provides that the stirrup is hooked into a longitudinal recess of the sheet metal component. The longitudinal recess is easy to produce, as the sheet metal components—as indicated at the beginning—are produced as free-falling punched parts. The longitudinal recess is therefore suitable to simply be punched out of the sheet metal.

Furthermore, a quick connection is possible at the construction site, since hooking represents the fastest connection method. The composite action of the component is further increased by pouring the transverse force reinforcement consisting of sheet metal component and stirrup through this longitudinal recess, as concrete pours between the remaining gap of the longitudinal recess in the sheet metal component during concreting and fills completely this gap completely after the concrete hardens.

It is advantageous for the production of a reinforced concrete component according to the present disclosure—if the longitudinal recesses in the sheet metal component comprise a means for securing the position of the stirrup. As a result, the stirrup is not moved in its position relative to the sheet metal component during concreting.

It is particularly advantageous to hereby realize the means for securing the position with a detent function, thereby enabling a quick installation and therefore savings in working time. As a result, the construction costs for a reinforced concrete component according to the present disclosure—are reduced.

It is particularly preferred for two stirrups to be attached to each sheet metal component. As a result, higher transverse force reinforcement degrees are suitable to be achieved without major additional installation efforts. Before concreting, two stirrups instead of one are introduced into one longitudinal recess of a sheet metal component.

The disclosure—provides particularly advantageously that the stirrup is made from structural steel with a diameter of 6 mm. This value determined by a large number of experiments according to the present disclosure—has many advantages at the same time. High bond strengths are suitable to be achieved. Simultaneously, installation at the construction site is simple, as reinforcement bars of that thickness are easily suitable to be deformed by a few millimeters. Complex geometries also are easy to reinforce with this.

It is particularly preferred for the stirrups to simply lie on the upper longitudinal reinforcement and extend through the latter. As a result, the stirrups, as part of the transverse force reinforcement, do not necessarily require being additionally secured in their position. The installation effort is further reduced, which reduces the production costs of a reinforced concrete component according to the present disclosure—.

It is hereby particularly advantageous for the stirrups to be installed at an angular position to the respective sheet metal component with a displacement of up to 45°. According to the present disclosure—, this ensures that as few stirrups sizes as possible have to be kept available.

Thus, identical stirrups are suitable to be used for reinforced concrete slabs with thicknesses of 18 cm or 20 cm, for example. Procurement at the construction site is therefore suitable to be reduced, causing a further reduction in the production costs for the reinforced concrete component.

The reinforced concrete component is particularly preferred if the stirrup length (hB), at a component thickness (h) smaller than 24 cm corresponds to the value of equation. It is equally advantageous if the stirrup length (hB) corresponds to the value of equation at a component thickness (h) greater than or equal to 24 cm. co hereby corresponds to the upper concrete cover and cu to the lower concrete cover.

Reinforced concrete components arranged in this way always have an optimum bearing ratio, as the stirrup is always located at a favorable angle. An optimum connection to the surrounding concrete is therefore achieved, and the stirrup is therefore not pulled out of the sheet metal slot.

The arrangement of the disclosure—is then particularly advantageous when the transverse force reinforcement is formed from so many L-shaped sheet metal components made from structural steel with stirrups attached thereto that the equation $$\frac{\beta \cdot V_{Ed}}{u_{krit}} \leq v_{Rd,max}$$

is satisfied.

Hereby are:

$u_{krit}$ the circumference of the critical perimeter according to section 10.5.2 of DIN 1045-1 in consideration of the following specifications, wherein DIN 1045-1, section 10.5.2 (14) does not apply here.

The critical perimeter has to be executed according to DIN 1045-1, section 10.5.2 for internal columns and supports close to openings in the plate. Columns at a distance of less than 6 h from at least one plate edge are considered edge or corner columns, respectively. For these columns, the perimeter has to be executed in accordance with DIN 1045-1, FIG. 41, wherein the distance to the border has to be set to 6 h (instead of 3 d according to FIG. 41). The latter applies if the execution of a perimeter according to DIN 145-1, FIG. 39, results in a smaller perimeter length.

β factor to increase the bearing load for ceiling systems mounted in a horizontally immovable manner according to DIN 1045-1, FIG. 44, or to booklet 525 of the Committee for Reinforced Concrete (DAfStb), section 10.5.3.

$V_{Ed}$ the design values of the exposures affecting the components $V_{Rd,max}=\alpha_{sheet\ metal}V_{Rd,ct}$ wherein $\alpha_{sheet\ metal}$ is the factor to be considered when increasing the load-bearing capacity due to the sheet metals.

| | Thickness of sheet metal t [mm] | Reinforcement ds | Max. number of stirrups | $\alpha_{sheet\ metal}$ |
|---|---|---|---|---|
| GM-L5/12 | 5 | 12 | 2 | 2.0 |
| GM-L5/10 | 5 | 10 | 1 | 1.7 |
| GM-L3/12 | 3 | 12 | 1 | 1.7 |
| GM-L3/10 | 3 | 10 | 1 | 1.5 |

$V_{Rd,ct}$ is calculated for inner, edge and corner columns as follows:

In the critical perimeter, the shear resistance $V_{Rd,ct}$ of the plate contributes to determining the maximum load-bearing capacity:

$$V_{Rd,ct} = \left[0,14 \cdot \kappa \cdot (100 \cdot \rho_l \cdot f_{ck})^{\frac{1}{3}}\right] \cdot d$$

κ the scale factor according to equation (106) in DIN 1045-1,

ρl average degree of longitudinal reinforcement within the perimeter considered d static height of component Furthermore, it is advantageous if the transverse force reinforcement is formed from so many L-shaped sheet metal components made from structural steel with stirrups attached thereto that the equation is satisfied.

Hereby corresponds:

β according to DIN 1045-1, FIG. 44 or according to booklet 525 of the Committee for Reinforced Concrete (DAfStb), section 10.5.3.

$V_{Rd,sy,L}$ to the punching shear resistance of the L-shaped sheet metals $$V_{Rd,sy,L}=k1\cdot V_{Rd,ct}\cdot u_l+2\cdot n_{stirrup}\,k2\cdot A_{s,stirrup}\cdot f_{yd}\cdot n_{sheet\ metals}$$

k1=1.70 for the perimeter at a distance of 0.5 d from the edge of the column k1=1.35 for the perimeter at a distance of 1.25 d from the edge of the column k1=1.00 for perimeters at a distance of ≥2.0 d from the edge of the column $u_l$ circumference of the perimeter in the determined section considered $n_{stirrups}$ number of stirrups per steel sheet (1 or 2)

k2 bond coefficient k2=0.8 for t=5 mm and 2ϕ12 mm k2=0.7 for t=5 mm and 2ϕ10 mm and for t=3 mm and 2ϕ12 mm k2=0.5 for t=3 mm and 2ϕ10 mm $A_{s,stirrup}$ cross-sectional surface of a stirrup leg $f_{yd}$ calculation value of the stirrup tension $n_{sheet\ metals}$ number of steel sheets in the perimeter considered A reinforced concrete component arranged in this way comprises a higher punching shear behavior than all comparable known solutions in the state of the art.

Furthermore, it is advantageous if the distances of the sheet metals towards the loaded surface (column) going in radii sr (radial direction) do not exceed the following values:

The distance of a sheet metal to the previous or following perimeter is not allowed to exceed 0.75 d.

The shortest distance between two sheet metals is not allowed to be less than the 3 cm.

Furthermore, the distances of the sheet metals to each other towards the course of the perimeters st (tangential direction) are advantageous within the following values:

$$st\leq 0.75\times d\times 0.8\times i\leq 3.5\times d$$

i number of the perimeter d static height of component

In this way, the highest load-bearing capacities are achieved according to the present disclosure—.

One of the production methods of a reinforced concrete component according to the present disclosure—provides that the L-shaped sheet metal components are first threaded onto the lowest longitudinal reinforcement layer. The sheet metal components are subsequently situated towards the top, as they grasp the recess of the longitudinal reinforcement in an interlocking manner and prevent overturning. The sheet metal components thereby protrude above the low longitudinal reinforcement layer, but do not yet touch the area of the upper longitudinal reinforcement layer. Subsequently, the stirrups are hooked into longitudinal recesses of the sheet metal components, and their shoulders lie against the uppermost longitudinal reinforcement layer. The reinforcement then is poured into a batch with concrete. After the concrete hardens, the reinforced concrete component is finished and suitable to be charged.

Particularly advantageous is to carry out pouring in two steps. For that purpose, the low longitudinal reinforcement is suitable to be poured with the sheet metal components after threading the sheet metal components into the lowest longitudinal reinforcement. This is suitable to occur in a prefabrication plant. After hardening, the plates produced in this manner are suitable to be transported to the construction site. Installation of the upper longitudinal reinforcement layer and hooking of the stirrups into the recesses of the sheet metal component are carried out here. Subsequently, the upper reinforcement layer is filled until the desired ceiling thickness is achieved. After the concrete hardens, the reinforced concrete component according to the present disclosure—is finished.

It is particularly advantageous to lock the stirrups into the recesses before the pouring with concrete in order to avoid any alterations in position by the stirrups in relation to the sheet metal component during concreting.

BRIEF DESCRIPTION OF THE DRAWINGS

Further characteristics, details and advantages of the disclosure—result from the text of the claims, as well as from the following description of embodiments on the basis of the figures. These figures show:

DETAILED DESCRIPTION OF THE DRAWINGS

Figure 1:
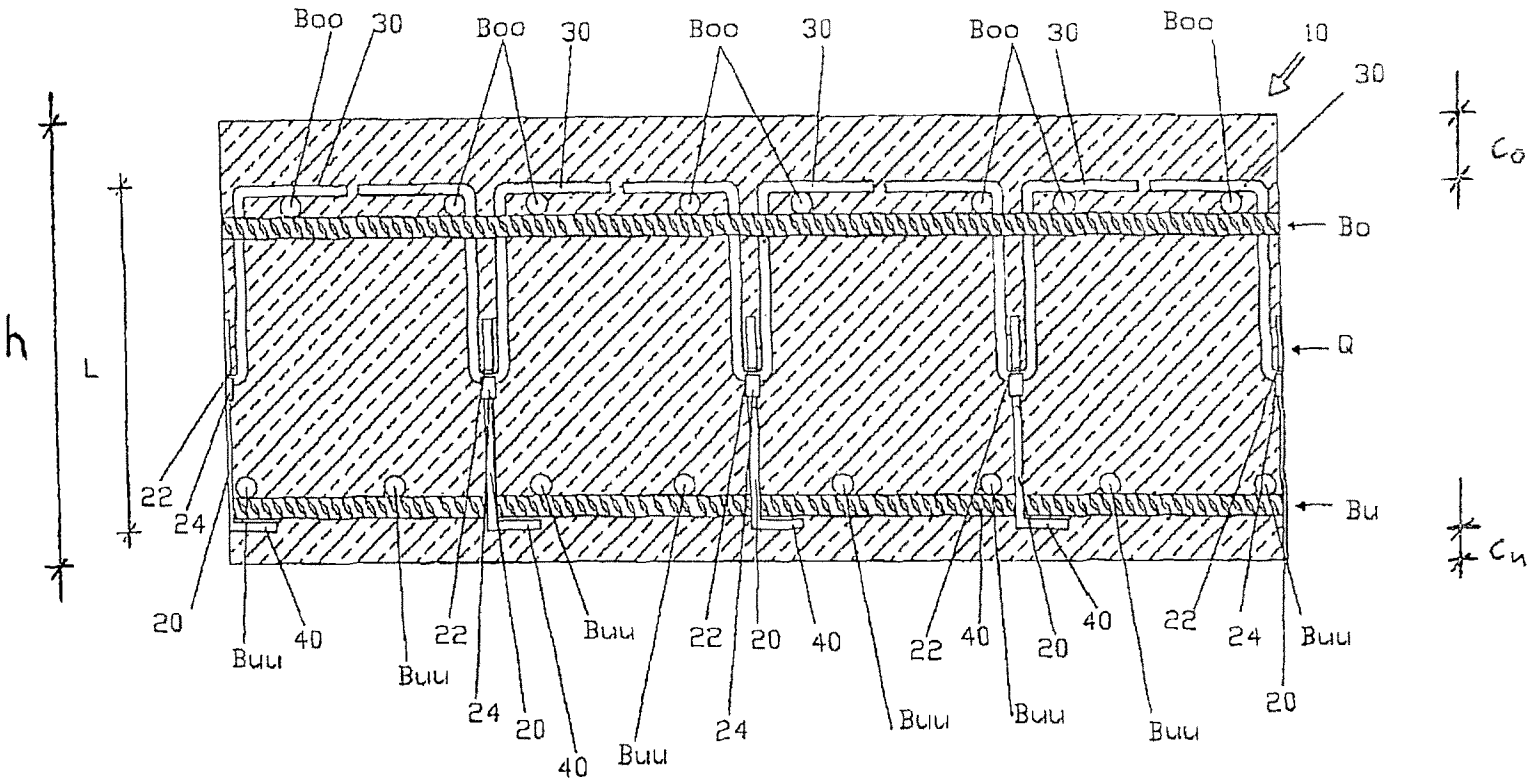
FIG. 1 is a section of a reinforced concrete component according to the present disclosure

FIG. 1 shows a section of a reinforced concrete component 10 with at least one upper longitudinal reinforcement layer Bo and at least one lower longitudinal reinforcement layer Bu, and one transverse force reinforcement Q, wherein the latter is passed above the uppermost longitudinal reinforcement Boo and the lowermost longitudinal reinforcement Buu in its extension L, wherein the transverse force reinforcement Q is formed by free-falling sheet metal components 20 with stirrups 30 attached thereto. Each sheet metal component 20 thereby comprises a chamfer 40 (also referred to herein as a bend or a fold). The chamfer 40 is hereby arranged at the side of the sheet metal component opposite to the stirrup. Each sheet metal component 20 comprises advantageously a thickness of 3 or 5 mm. The reinforced concrete component thickness h covers the entire cross-section. The upper concrete covering co is arranged from the upper end of the component to the beginning of the stirrup 30. The lower concrete cover cu passes from the end of the sheet metal 20 to the lower end of the component.

Furthermore, FIG. 1 shows that the sheet metal components 20 are arranged parallel to each other. The stirrups 30 are thereby hooked into a longitudinal recess 22 of the sheet metal component 20. The clip sheet metal component 24 ensures the secure attachment of the stirrup 30 in the longitudinal recess 22 of the sheet metal component 20. The clip sheet metal component 24 thereby acts as a lock-in nose, which prevents the stirrup from inadvertently slipping out of the longitudinal recess 22 of the sheet metal component 20.

The stirrups 30 lie with their side facing away from the sheet metal component 20 by means of a bend arranged in an approximately right-angled manner on the uppermost layer Boo of the longitudinal reinforcement Bo. Furthermore, the stirrups 30 are arranged in an almost T-shaped manner, and are produced by means of a bending technique according to the present disclosure—.

Figure 2A:
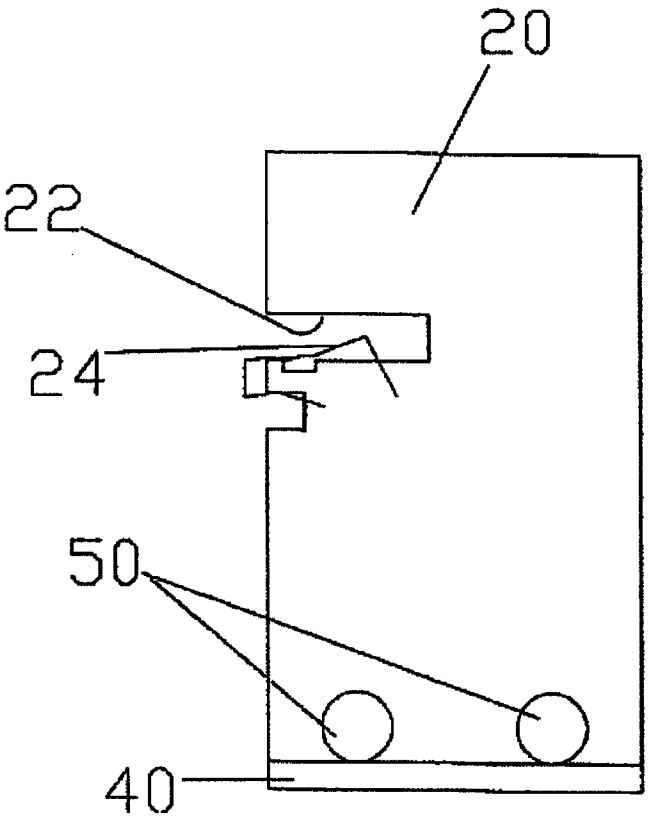
FIG. 2*a* is a L-shaped sheet metal component in side view

FIG. 2*a* shows a sheet metal component 20 with a longitudinal recess 22 and a clip sheet metal component 24 attached thereto. A chamfer 40 is formed in the lower area of the sheet metal component 20. Circular recesses 50 are located on top of the chamfer 40.

Figure 2B:
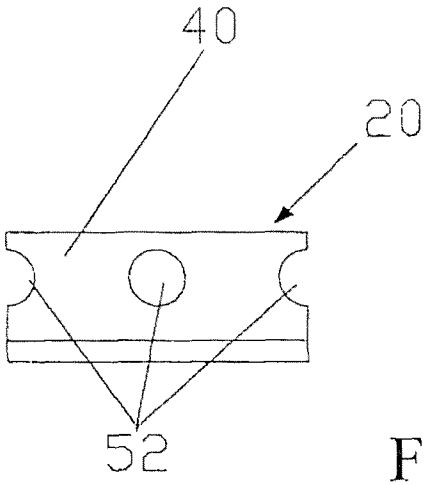
FIG. 2*b* is a L-shaped sheet metal component

FIG. 2*b* shows a sheet metal component 20 in which cutouts 52 are arranged within the chamfer 40: these recesses significantly increase the connection of the sheet metal component 20 with the concrete.

Figure 2C:
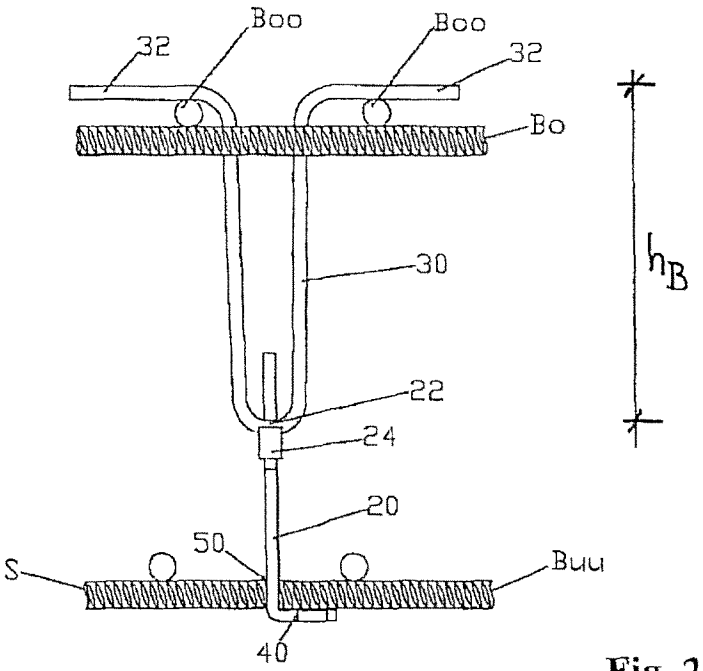
FIG. 2*c* is a L-shaped sheet metal component with inserted stirrup in front view

FIG. 2*c* shows an L-shaped sheet metal component with inserted stirrup 30 in front view before concrete is poured in. The sheet metal component 20 is thereby passed over the lowest longitudinal reinforcement layer Buu, wherein the chamfer 40 grasps the lower longitudinal reinforcement bar S. Two longitudinal reinforcement bars S are respectively passed through the recesses 50, and ensure the secure connection between sheet metal component 20 and the lower longitudinal reinforcement layer Buu. The clip sheet metal component 24 retains the stirrup in the longitudinal recess 22 of the sheet metal component 20. The stirrup 30 has two shoulders which lie on the uppermost layer Boo of the upper longitudinal reinforcement Bo.

Figure 3A:
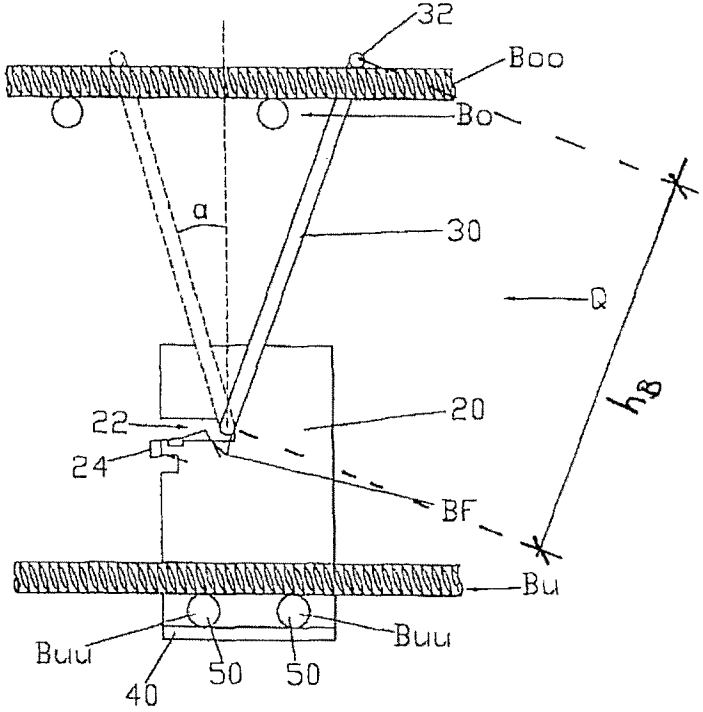
FIG. 3*a* is a L-shaped sheet metal component with inserted stirrup in side view

FIG. 3*a* shows the same installation situation as in FIG. 2*c*, but in its side view. The stirrup 30 is suitable to be attached in any way with regard to an angle α to the vertical axis. As a result, the time-consuming alignment of the stirrup 30 relative to the sheet metal component 20 is unnecessary.

The stirrup 30 is retained in the longitudinal recess 22 by the clip sheet metal component 24 within a retaining area BF. Furthermore, FIG. 3*a* shows that the lowermost reinforcement layer Buu of the longitudinal reinforcement Bu is passed through the recesses 50. The chamfer 40 is advantageously arranged close to the recesses 50. The sheet metal component 20 and the stirrup 30 thereby form the transverse force reinforcement Q according to the present disclosure—for a reinforced concrete component 10 according to the present disclosure—.

Figure 3B:
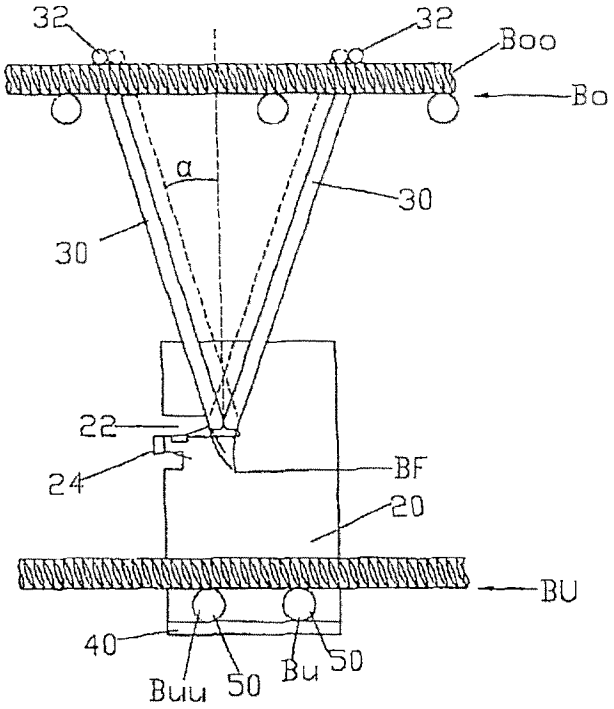
FIG. 3*b* is a L-shaped sheet metal component with two inserted stirrups in side view

FIG. 3*b* shows, by way of example, that it is also possible to use two stirrups 30 per sheet metal component 20. Both stirrups 30 are retained here within a retaining area BF in a secured manner by the clip sheet metal component 24 in the required position. The respective shoulders 32 lie on the uppermost longitudinal reinforcement layer Boo. The stirrups 30 therefore form the transverse force reinforcement Q in combination with the sheet metal component 20.

Figure 4:
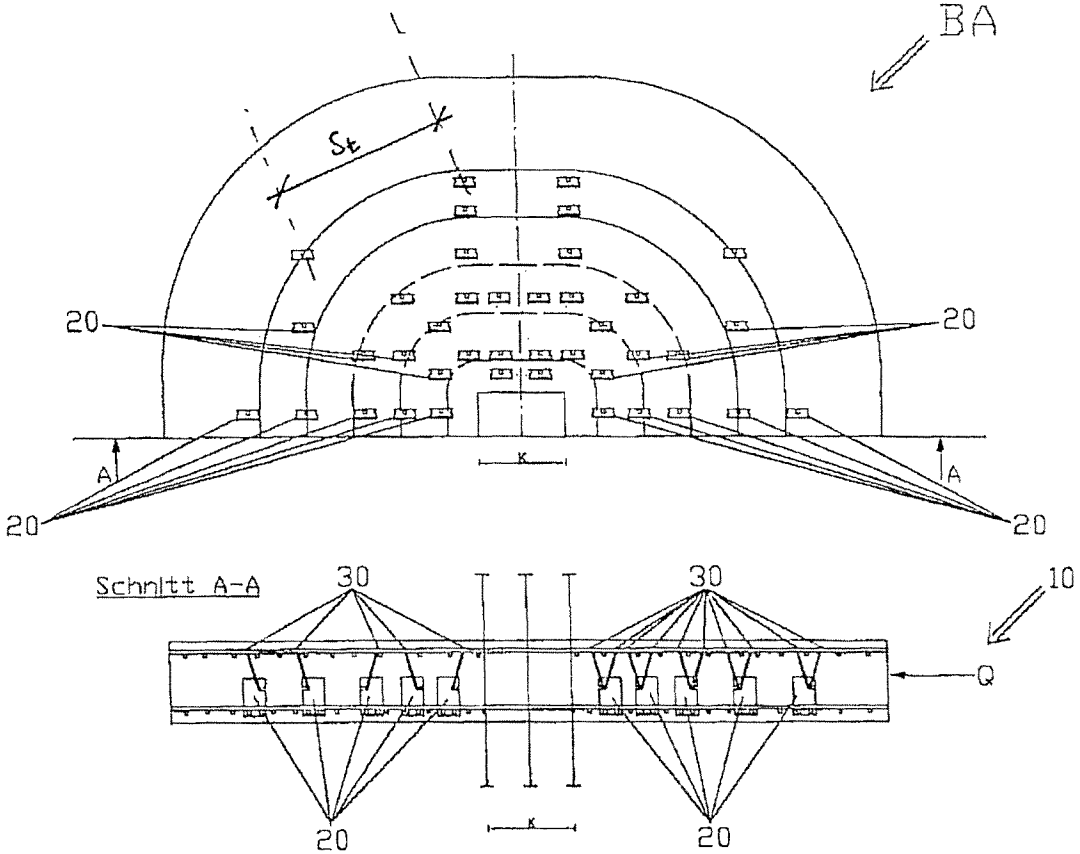
FIG. 4 is a reinforcement arrangement of a reinforced concrete component according to the present disclosure

FIG. 4 shows a reinforcement arrangement BA using at least 20 L-shaped sheet metal components 20 produced in a free-falling manner from structural steel with stirrups 30 attached thereto. One recognizes that the sheet metal components 20 are arranged in a concentric manner around a core area K. The sheet metal components 20 are thereby situated in correspondence with one or two stirrups 30 and therefore mutually form the transverse force reinforcement Q.

The disclosure—is not limited to one of the previously described embodiments; rather, it is suitable for being modified in all kinds of ways.

All of the characteristics and advantages originating from the claims, description and figures, including constructive details, spatial arrangements and steps of the method, are suitable to be essential to the disclosure—, both in themselves and in the most diverse combinations.

I claim:

1. Reinforced concrete component comprising:

at least one upper and at least one lower longitudinal reinforcement layer and one transverse force reinforcement, wherein the transverse force reinforcement is passed above an uppermost and a lowermost longitudinal reinforcement in its extension L, wherein the transverse force reinforcement is formed by at least 20 L-shaped sheet metal components made from structural steel with stirrups attached thereto.

2. Reinforced concrete component according to claim 1, wherein the transverse force reinforcement comprises at least 50 L-shaped sheet metal components with stirrups attached thereto.

3. Reinforced concrete component according to claim 1, wherein the transverse force reinforcement at least 70 L-shaped sheet metal components with stirrups attached thereto.

4. Reinforced concrete component according to claim 1, wherein each sheet metal component comprises a bend.

5. Reinforced concrete component according to claim 4, wherein the bend is arranged at a side of the respective sheet metal component opposite to the respective stirrup.

6. Reinforced concrete component according to claim 4, wherein two circular apertures at the bend are arranged in every respective sheet metal component.

7. Reinforced concrete component according to claim 6, wherein a longitudinal reinforcement bar is passed through each circular aperture.

8. Reinforced concrete component according to claim 6, wherein the bend comprise additional cut-outs.

9. Reinforced concrete component according to claim 1, wherein each sheet metal component comprises a thickness of 3 mm or 5 mm.

10. Reinforced concrete component according to claim 1, wherein the sheet metal components are arranged with uniform distribution around an area.

11. Reinforced concrete component according to claim 1, wherein the sheet metal components are arranged parallel to each other.

12. Reinforced concrete component according to claim 1, wherein each stirrup is hooked into a longitudinal recess of a sheet metal component.

13. Reinforced concrete component according to claim 12, wherein the longitudinal recess comprises a means for securing the position for the stirrup.

14. Reinforced concrete component according to claim 13, wherein the means for securing the position comprises a lock-in nose.

15. Reinforced concrete component according to claim 14, wherein the lock-in nose comprises a clip sheet metal component.

16. Reinforced concrete component according to claim 1, wherein two stirrups are attached to each sheet metal component.

17. Reinforced concrete component according to claim 1, wherein the stirrups each consist of formed structural steel with a diameter of 6 mm.

18. Reinforced concrete component according to claim 1, wherein the stirrups lie on the upper longitudinal reinforcement.

19. Reinforced concrete component according to claim 1, wherein the stirrups are installed at an angular position to the respective sheet metal component with a displacement of up to a maximum of 45°.

20. Reinforced concrete component according to claim 1, wherein each stirrup has a length $H_B$ and the reinforced concrete component has a component thickness h, and wherein the stirrup length $H_B$ at a component thickness h smaller than 24 cm corresponds to the value of equation $H_B=(h-c_o-c_u-7.5)*1.06$, wherein $c_o$ is equal to a thickness of the uppermost longitudinal reinforcement, and wherein $c_u$ is equal to a thickness of the lowermost longitudinal reinforcement.

21. Reinforced concrete component according to claim 1, wherein each stirrup has a length $H_B$ and the reinforced concrete component has a component thickness h, and wherein the stirrup length $H_B$ at a component thickness h greater or equal to 24 cm corresponds to the value of equation $H_B=h-c_o-c_u-6.5$, wherein $c_o$ is equal to a thickness of the uppermost longitudinal reinforcement, and wherein $c_u$ is equal to a thickness of the lowermost longitudinal reinforcement.

22. Reinforced concrete component according to claim 1, wherein the transverse force reinforcement is formed from so many L-shaped sheet metal components made from structural steel with stirrups attached thereto that the equation $$\frac{\beta \cdot V_{Ed}}{u_{krit}} \leq v_{Rd,max}$$

is satisfied.

23. Reinforced concrete component according to claim 1, wherein the transverse force reinforcement is formed from so many L-shaped sheet metal components made from structural steel with stirrups attached thereto that the equation $\beta \cdot V_{Ed} \leq V_{Rd,sy,L}$ is satisfied.

24. Reinforced concrete component according to claim 1, wherein each stirrup consists of formed structural steel with a round cross-section.

25. Production method for a reinforced concrete component including at least one upper and at least one lower longitudinal reinforcement layer and one transverse force reinforcement, wherein the one transverse force reinforcement is passed above an uppermost and a lowermost longitudinal reinforcement in its extension L, wherein the transverse force reinforcement is formed by at least 20 L-shaped sheet metal components made from structural steel with stirrups attached thereto, wherein each metal sheet component has a longitudinal recess, the method comprising:

threading the L-shaped sheet metal components onto the lowest longitudinal reinforcement;

hooking the stirrups into the longitudinal recesses of the sheet metal components, wherein shoulders of the stirrups lie on the uppermost layer of the longitudinal reinforcement; and pouring with concrete.

26. Method according to claim 25, wherein the stirrups are locked into the longitudinal recesses before being completely poured with concrete.

27. Method according to claim 25, wherein pouring with concrete is carried out in two steps.

* * * * *

UNITED STATES PATENT AND TRADEMARK OFFICE

CERTIFICATE OF CORRECTION

PATENT NO. : 8,815,366 B2
APPLICATION NO. : 13/387590
DATED : August 26, 2014
INVENTOR(S) : Gerd Günther It is certified that error appears in the above-identified patent and that said Letters Patent is hereby corrected as shown below:

In the Claims,

Claim 20, Col. 11, line 1, "equation" should be
"equation: $h_B=(h - c_o - c_u - 7.5)*1.06$"

Claim 21, Col. 11, line 9, "equation" should be
"equation: $h_B=h - c_o - c_u - 6.5$"

Signed and Sealed this
Twenty-third Day of December, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,815,366 B2
APPLICATION NO. : 13/387590
DATED : August 26, 2014
INVENTOR(S) : Gerd Günther It is certified that error appears in the above-identified patent and that said Letters Patent is hereby corrected as shown below:

In the Specifications

Col. 5, line 63, "equation" should be
"equation: $h_B=(h - c_o - c_u - 7.5)*1.06$"

Col. 5, line 65, "equation" should be
"equation: $h_B=h - c_o - c_u - 6.5$"

This certificate supersedes the Certificate of Correction issued December 23, 2014.

Signed and Sealed this
Seventeenth Day of February, 2015

Michelle K. Lee

Michelle K. Lee
*Deputy Director of the United States Patent and Trademark Office*